US006932713B1

(12) United States Patent
Kim

(10) Patent No.: US 6,932,713 B1
(45) Date of Patent: Aug. 23, 2005

(54) GOLF TEACHING APPARATUS AND METHOD

(76) Inventor: Hyoung J. Kim, 12819 SE. 38th St., #144, Bellevue, WA (US) 98006

( * ) Notice: Subject to any disclaimer, the term of this patent is extended or adjusted under 35 U.S.C. 154(b) by 0 days.

(21) Appl. No.: 10/943,763

(22) Filed: Sep. 17, 2004

Related U.S. Application Data

(60) Provisional application No. 60/504,465, filed on Sep. 17, 2003.

(51) Int. Cl.[7] ..... A63B 69/36
(52) U.S. Cl. ..... 473/266; 473/227
(58) Field of Search ..... 473/207, 215, 473/219, 226, 227, 266, 276, 277

(56) References Cited

U.S. PATENT DOCUMENTS 3,595,583 A 7/1971 Oppenheimer
4,582,325 A 4/1986 Yuhara
5,156,401 A 10/1992 Hodgkiss
5,342,055 A 8/1994 Diley
5,465,971 A 11/1995 Tischler
5,520,392 A * 5/1996 Foresi et al. ..... 473/227
5,551,696 A 9/1996 Izett et al.
5,997,408 A * 12/1999 Bankhead ..... 473/227
6,004,221 A 12/1999 Thornhill
6,358,156 B1 3/2002 Moran
6,471,598 B2 10/2002 Takase

* cited by examiner

*Primary Examiner*—Stephen Blau
*Assistant Examiner*—Nini F. Legesse
(74) *Attorney, Agent, or Firm*—Hughes Law Firm, PLLC; Robert B. Hughes

(57) ABSTRACT

An apparatus and method for assisting a golfer to improve his/her putting stroke. The apparatus comprises two elongate positioning members having two upper end portions which the golfer places between his/her upper arm portions and upper side torso portions. The shaft of the putter is connected to the two lower end portions of the positioning members. The golfer grasps the hand grip of the putter while his/her upper arms press against the upper end portions of the positioning members. Thus the golfer's upper torso portion, the two positioning members, and the putter, are substantially stationary relative to one another. Then the golfer properly executes the putting stroke by moving the upper torso to cause the golfer's arms, the positioning members and the putter to move as a unit with the golfer's upper torso portion.

22 Claims, 9 Drawing Sheets

GOLF TEACHING APPARATUS AND METHOD

RELATED APPLICATIONS

This application claims priority benefit of Provisional Application U.S. Ser. No. 60/504,465, filed Sep. 17, 2003.

BACKGROUND OF THE INVENTION a) Field of the Invention

The present invention relates to an apparatus and method for improving a person's golf game, and more particularly to a teaching apparatus and method to improve and develop a putting stroke.

b) Background Art

Over a number of decades, various devices and methods have been designed for improving a person's golf game. A number of these have been mechanical devices to cause the person's golf swing to be executed along a desired path and/or in a certain manner, and also for properly positioning the golfer in the initial stance and the execution of the stroke.

A search of the U.S. patent literature has disclosed a number of these, and these are as follows:

U.S. Pat. No. 5,156,401 (Hodgkis) shows a device which is an attachment to a putter. There is provided a cross-member 12 having end portions 23, and this cross-member 12 is rigidly attached to the putter. As a person grasps the putter handle, the two end portions 23 of the cross-member 12 fit beneath the person's arms on opposite sides of the person's chest. The purpose of this is to make contact with the person's body in such a manner so as to restrain the movement of the golf club along a predetermined path.

U.S. Pat. No. 6,471,598 B2 (Takase) shows a device that attaches to the club and the user's left arm to train the golfer to move the club in a straight path.

U.S. Pat. No. 6,358,156 B1 (Moran) provides a device that binds the player's arms in the proper position for holding the club and exacting a proper swing. The guiding device is joined to the club guiding it as well as the golfer's motions.

U.S. Pat. No. 6,004,221 (Thornhill) shows a framework that attaches to the putter and contacting either side of the user's body.

U.S. Pat. No. 5,551,696 (Izett et al.) shows a two-handled putter that is held in each hand. Some of the embodiments include handles of different lengths.

U.S. Pat. No. 5,465,971 (Tischler) shows a training aid that engages the user's right armpit, and tends to direct and align the club.

U.S. Pat. No. 5,342,055 (Diley) provides a putting training aid that engages the club and loops around the neck to help align the club.

U.S. Pat. No. 4,582,325 (Yuhara) shows a device that generates a signal to a computer or the like that can be used to analyse the swing motion. The device appears that it may also aid in providing guidance for the club's path.

U.S. Pat. No. 3,595,583 (Oppenheimer) provides a framework and a means to guide a golfer's swing.

EMBODIMENTS OF THE PRESENT INVENTION

It is believed that a clearer understanding of the apparatus 10 of the present invention and the method associated with the same will be obtained by first describing generally the overall configuration of a first embodiment of the present invention and the manner in which it is used. This will be followed by a more detailed description of various functional relationships of this first embodiment, and then a description of the further embodiments.

Figure 3:
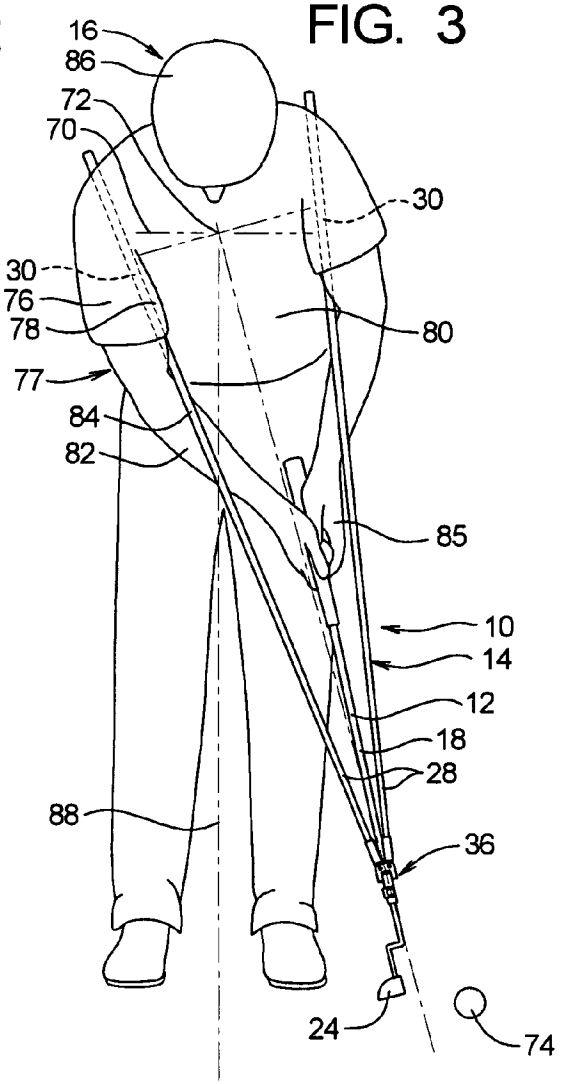
FIGS. 1, 2, and 3 are front views showing a golfer utilizing the apparatus of the present invention, with FIG. 1 showing a golfer in the putting stance at the start of the putting stroke, FIG. 2 showing the completion of the back swing, and FIG. 3 showing the golfer and the apparatus positioned at the completion of the putting stroke.
Figure 2:
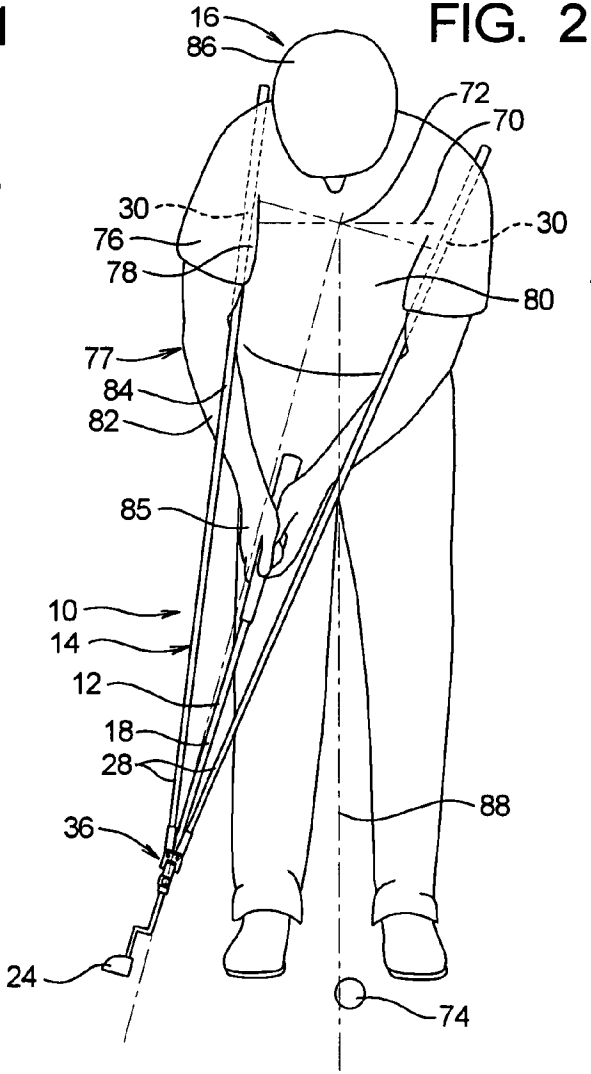
Figure 1:
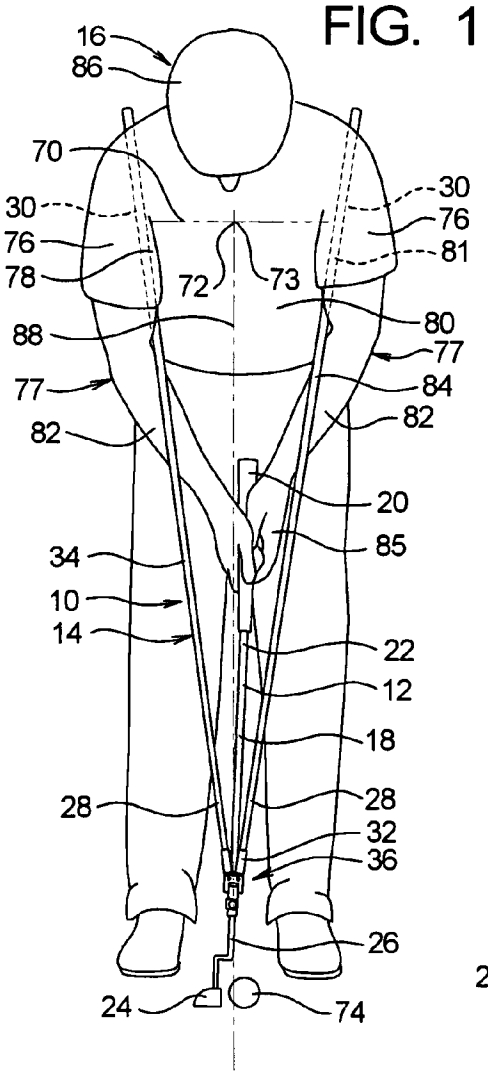

The present invention is a teaching apparatus designed to assist a golfer in improving his/her putting stroke, and the apparatus 10 can be described as functioning as a positioning and stroke control apparatus. Reference is first made to FIGS. 1–3, which show the apparatus 10 being used in three sequential stages, and also to FIG. 4 which is a side elevational view of FIG. 1.

In FIGS. 1–4, the apparatus 10 is shown in its operating position attached to a putter 12 with the apparatus 10 and the putter 12 forming an assembly, generally designated 14. The golfer is indicated at 16, and in FIGS. 1–3 the golfer 16 is in the putting stance using the putter 12 and the apparatus 10 in executing a putting stroke. The putter 12 is, or may be, a conventional putter, and it comprises a shaft 18, a handle or hand grip portion 20 connected to an upper end portion 22 of the shaft 18, and a putter head 24 attached to a lower shaft portion 26.

The apparatus 10 comprises two elongate positioning members 28, each of which has an upper body contact portion 30, a lower putter connecting portion 32, and an intermediate portion 34 extending between the contact portion and connecting portion 30 and 32, respectively. The lower putter connecting portion 32 connects to a connecting section 36 which in turn connects the lower connecting portions 32 of the positioning members 28 to the lower shaft portion 26 of the putter shaft 18. In this first embodiment, the position members 28 are shown as elongate rods or poles having sufficient length so that these are able to extend from the connecting section 36 upwardly and along the upper side torso portions of the golfer 16.

One arrangement of this connecting section 36 is shown in FIGS. 5–8. In this particular design of the connecting section 36, there is a mounting portion 38 which is arranged to have a position adjustable rigid connection to the lower shaft portion 26, and also a position member connecting portion 40 which connects the mounting portion 38 to the two lower putter connecting portions 32 of the two positioning members 28.

In this particular arrangement, the mounting section 38 comprises a U-shaped bracket 42 (See FIG. 8) having a middle portion 44 and first and second end portions 46 and 48 perpendicular to the middle portion 44. The first end portion 46 is positioned to bear against the lower shaft portion 26, and the second end portion 48 has a clamping screw 50 extending threadedly through a threaded opening in the second end portion 48. The clamping screw 50 bears against a vertically aligned shaft engaging member 52 and has a vertical groove 54 to engage the lower shaft portion 26. Thus, the clamping screw 50 is able to bear against the vertically aligned shaft engaging member 52 to clamp the mounting section 38 against the lower shaft portion 26.

The positioning member connecting portion 40 comprises an intermediate connecting member 56 which has a lower end portion 58 pivotally mounted to the vertically aligned member 52 about a first axis of rotation at 60. At the upper end of the intermediate connecting member 56, there are two upwardly extending connecting ears 62 which are spaced from one another to define a slot-like opening aligned along a direction parallel to the axis 60. Connecting to the lower end of each positioning member 28 is a connecting member 64 which fits between the two connecting ears 62 at a pivot connection, so that each of these can rotate about a respective one of two axes of rotation 66.

Figure 6:
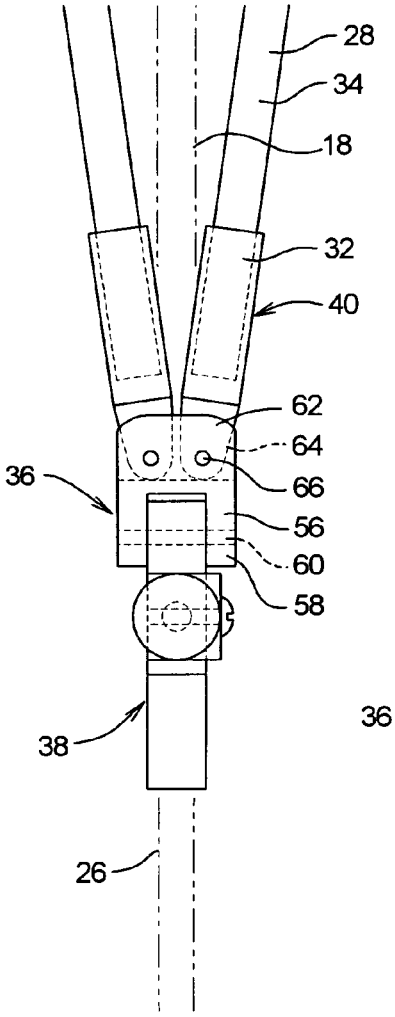
FIG. 6 is an elevational view taken from the left side of FIG. 5.
Figure 7:
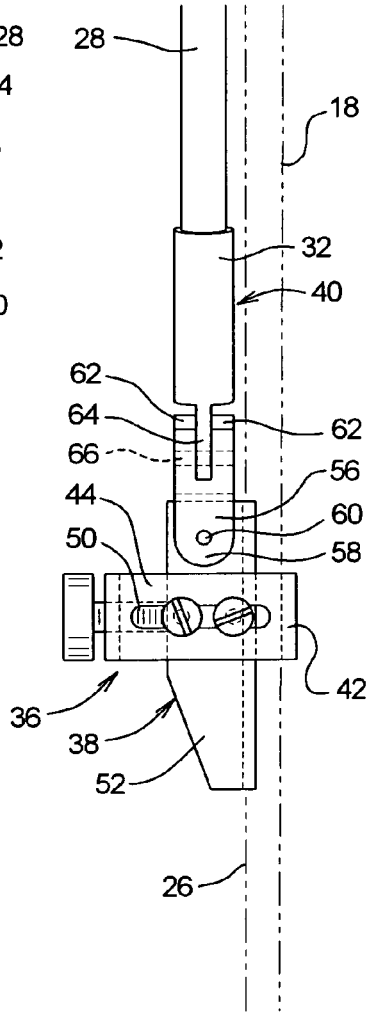
FIG. 7 is a side elevational view taken from the opposite side relative to FIG. 6.
Figure 8:
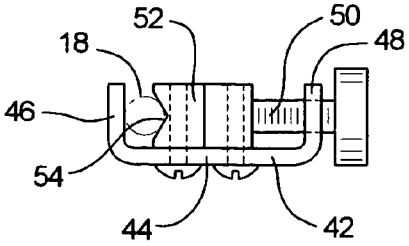
FIG. 8 is a bottom view of the connecting section as shown in FIG. 5.

Thus, it can be seen in FIG. 6 that the two positioning members 28 can rotate about their respective axes of rotation 66, so that the upper end portions 30 of the positioning members 28 can be moved toward and away from each other pivotally with respect to the connecting section 36. Also, it can be seen by observing FIGS. 5–7 that the two positioning members 28 can be moved pivotally toward and away from the shaft 18 about the pivot axis 60.

The connecting section 36 can be selectively located at different locations along the shaft 18, this being accomplished quite easily by loosening the positioning screw 50 and moving the connecting member 36 vertically, and then tightening the positioning screw 50.

There will now be descriptions of the method of this first embodiment of the present invention. However, it is believed that before doing so, an understanding of the following text would be facilitated by providing a reference framework of the various features and functions.

Figure 4:
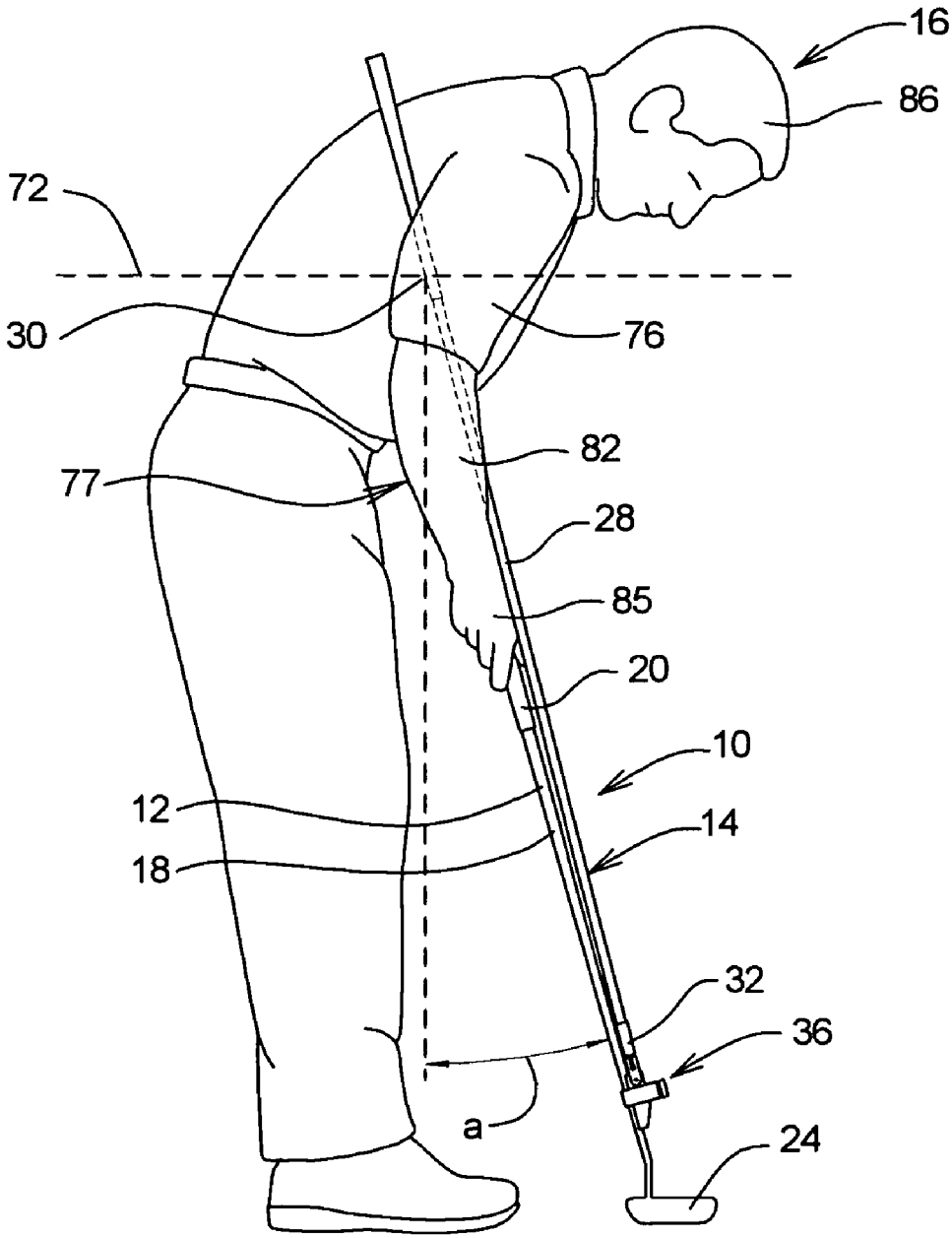
FIG. 4 is a side elevational view of the golfer and the apparatus as shown in FIG. 1.

In FIGS. 1 and 4, the golfer 16 is shown in the putting stance with the assembly 14 of this first embodiment (comprising the apparatus 10 and the putter 12 connected to one another in the operating position). The term "forward" shall be used to denote the direction in which the golfer 16 is facing in executing the putting stroke as illustrated in FIGS. 1–4, and the term "rear" or "rearward" shall denote the opposite. A lateral axis 70 shall be considered to be a horizontal axis extending perpendicular to a forward to rear axis 72 (see FIG. 4), with this lateral axis being shown at 70 in FIGS. 1–3. The forward to rear axis 72 is defined as a horizontal axis which extends in a forward to rear direction perpendicular to the axis 70. The two axes 70 and 72 meet at a juncture location indicated at 73 and is between upper central portion of the torso or above the torso and the eye level of the person making the putt.

The first step in the method of this first embodiment, is to connect the apparatus 10 to the shaft 18, and in this case the lower shaft portion 26 of the putter 18 by using the connecting section 36 in the manner described above, thus forming the assembly 14.

The golfer 16 assumes his/her putting stance, such as shown in FIGS. 1 and 4, for example, relative to a golf ball shown in FIGS. 1–3 at 74. With the golfer's body in the putting stance, the golfer locates the positioning members 28 so that these extend upwardly from the connecting section 36 along a line that is generally vertical (with a moderate rearward and outward slant, depending on the putting stance of the golfer 16), and so that the two upper contact portions 30 of the positioning members 28 are each located between the golfer's upper arm portions 76 of the arm 77 and the upper side portion 78 of the golfer's upper torso portion 80 at an upper contact region, the approximate upper location of which is indicated at 81.

Then, the golfer 68 grasps the handle 20 of the putter 12. The golfer 16 also presses his upper arm portions 76 inwardly toward the upper side portions 78 of his upper torso portion 80 so as to grip the upper body contact portion 30 of the related positioning member 28 to hold each upper body contact portion 30 of each positioning member 28 securely between the upper arm portion 76 and the upper side torso portion 78 at an upper contact location 81.

With the shaft 18 of the putter 12 being pivotally connected to the two positioning members 28, when the golfer first grips the putter, he golfer has the feel where in gripping the club, he has control of the movement of the club at the handle. Then when the golfer presses his/her upper arm portions 76 against the upper torso engaging portions 30 of the guide members 28, the upper arm portions 76 become essentially stationary, so that the elbow location of the upper arm portions are stationary. Thus, when the golfer grips the hand grip portion of the putter 12 in a grip to execute the putting stroke, the forearms 82 of the golfer and his/her hand location remain substantially stationary with the upper torso portion of the golfer.

Also, as can be seen in FIGS. 1–4, each of the positioning members 28 crosses over, and is in contact with, an upper portion of the golfer's forearm 82 at an approximate lower contact location 84 moderately below the location of the upper body contact portion 30 of the approximate positioning member 28 at the location 81.

With the two positioning members 28 properly secured against the side portion of the person's torso and with the golfer's hands 85 grasping the handle 20 of the putter 18, the golfer 16 (positioned in the putting stance) is now able to execute a proper putting stroke by which the putter head 24 travels in the back stroke away from the ball 74 by the golfer rotating the entire upper body portion as a unit about the forward to rear axis 72 in a clockwise direction as shown in FIG. 2, and the putter is then moved through the putting stroke with the golfer's upper body rotating in a counter-clockwise direction as seen in FIG. 3.

As indicated earlier in this text, the present invention is designed to assist the golfer in developing and executing a putting stroke as described above, where the golfer's head and the lower part of the golfer's body (i.e., that is below the golfer's waist) remain substantially stationary throughout the putting motion, and the putting stroke is accomplished by the movement of the upper part of the person's body (including the person's arms) and the putter 12, all functioning as a unit where the relative positions of the putter 12, the apparatus 10, and the golfer's upper torso, and the arms and hands are fixed with respect to one another.

To summarize certain features and to explain further how the method of the present invention is accomplished by using this apparatus 10 of the present invention, reference is made first to FIG. 1 which shows the golfer 68 in the putting stance with the golfer's head 86 looking downwardly toward the ball 74 along a line of sight 88 toward the ball 74. The golfer is holding the putter 12 in a position where the shaft 18 is positioned in a vertical plane aligned in a forward to rear direction, with the shaft 18 extending in a downward direction and generally with a moderately forward slant (depending on the stance of the golfer 16).

The positioning members 28 are connected at their lower ends to the connecting section 36 that is in turn connected to the shaft. These elongate positioning members 28 extend upwardly with a moderate rearward slant, and moderately outwardly from one another to engage the forearms 82 of the golfer at the location 84, and the upper contact portions 30 being located between the golfer's upper arm portions 76 and upper side torso portions 78 at the upper contact locations 81. The golfer presses his upper arm portions 76 laterally inwardly to firmly engage the upper body contact portions 30 of the positioning members 28 which are thus frictionally held between the upper arm portions 76 and upper side portions 78 of the person's torso. Also, this causes the golfer's two elbow portions to be held in a fixed location relative to the golfer's upper torso 80.

Figure 4A:
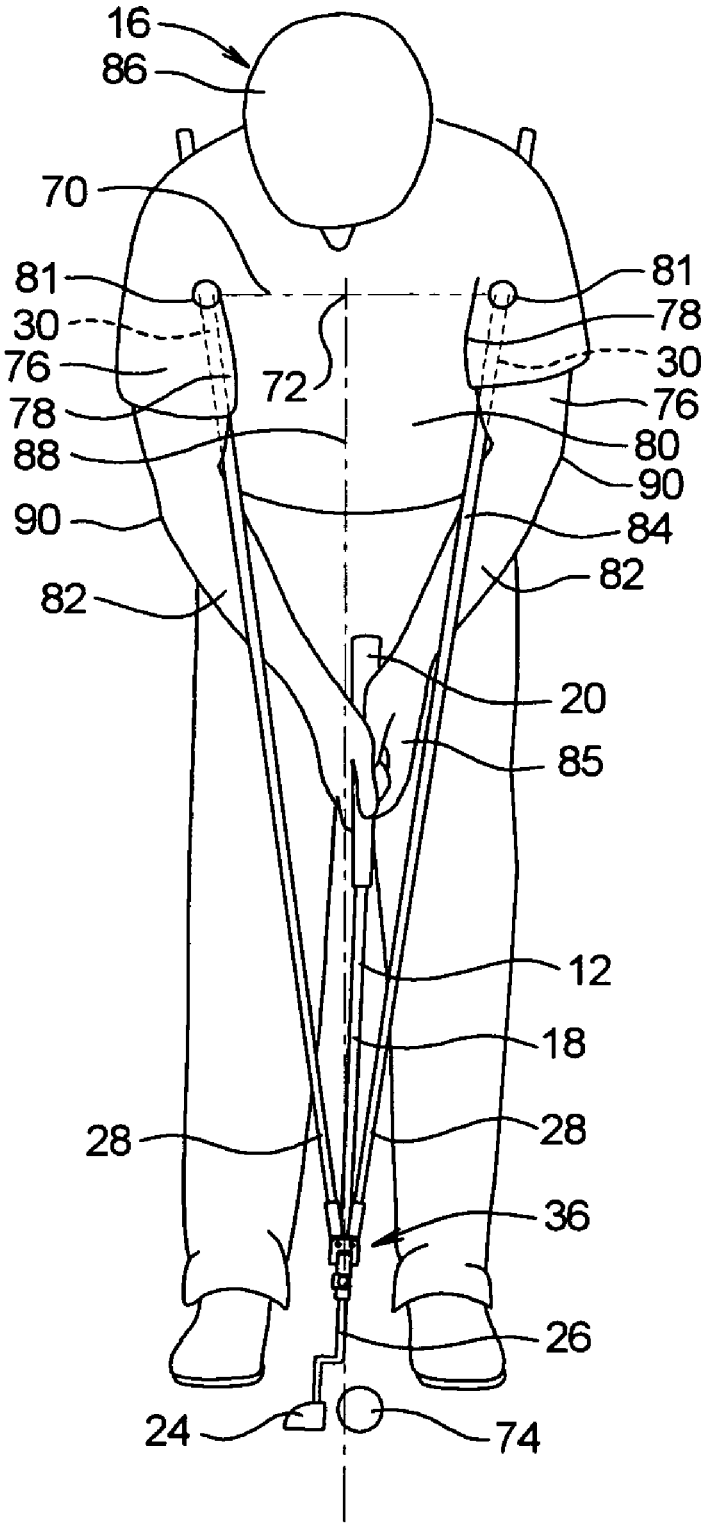
FIG. 4A is substantially the same as FIG. 1, but for purposes of illustration some of the numerical designations have been omitted, and the designations included are to indicate certain key components and/or locations in the functioning of the present invention.

At this point, let us examine the effect of the golfer 68 assuming this position with the assembly 14 (comprising putter 12 in the apparatus 10 connected to one another), as described immediately above and as shown in FIG. 1. To illustrate this, reference is made to FIG. 4A which shows schematically certain locations and components of the two positioning members 28, the putter 12, and the golfer's upper body.

We begin by recognizing that the pressure of the golfer's upper arm portions 76 at the contact location 81 (shown in FIG. 4A) fixes the location of the upper body contact portion 30 of the positioning members 28 relative to the person's upper body portion (i.e., the upper torso 80). Further, with the person pressing both upper arm portions 76 against the side portion of the person's upper torso portion 80, the elbow location 90 at the lower end of each of the forearms 76 also becomes fixed relative to the person's upper torso portion 80.

We now note that the two positioning members 28 which have their lower end portions connected at the location of the connector 36, with the result being that we have structurally a rigid triangle frame with two of the end points being between the two contact locations 81 and the third end point at the connecting location at 36. Therefore, the position of the connecting location at 36 relative to lateral movement toward the right or left of the positioning members 28 is fixed, and the lower portion 26 of the shaft 18 at the location of the connecting location at 36 is also fixed, relative to the contact locations 81.

Now, we look at the two elbow locations 90 which (as indicated above) are substantially fixed when the golfer 16 is pressing his upper arm portions 76 against the side of his torso 80. The two forearms 82 extend downwardly and inwardly, with the person's hands 35 gripping the handle 20 of the golf club in a putting grip. Thus, we have two fixed locations at 90 and a third fixed location at the club handle 20 which form a substantially structurally rigid triangle. Therefore, with the two elbow locations 90 being fixed relative to the person's torso 80, the upper hand grip portion 20 of the shaft 18 is also fixed relative to the person's torso and to the contact locations 81.

Now, it becomes evident that if the person maintains the position shown in FIG. 1, and with the person still pressing the upper arm portion 76 against the upper contact portions 30 of the positioning members 28 so that these upper contact portions 30 are pressed against a golfer's upper torso portion 80, the only way that the putter head 24 can move right or left from the position of FIG. 1 is by causing a rotation of the upper body portion.

This rotation of the person's upper torso 80 can take place at about the location of the forward to rear axis 72 so that the putter head 24 moves approximately in a laterally aligned vertical plane, or rotate at a location above the axis 72 and closer to the golfer's head location.

Figure 4B:
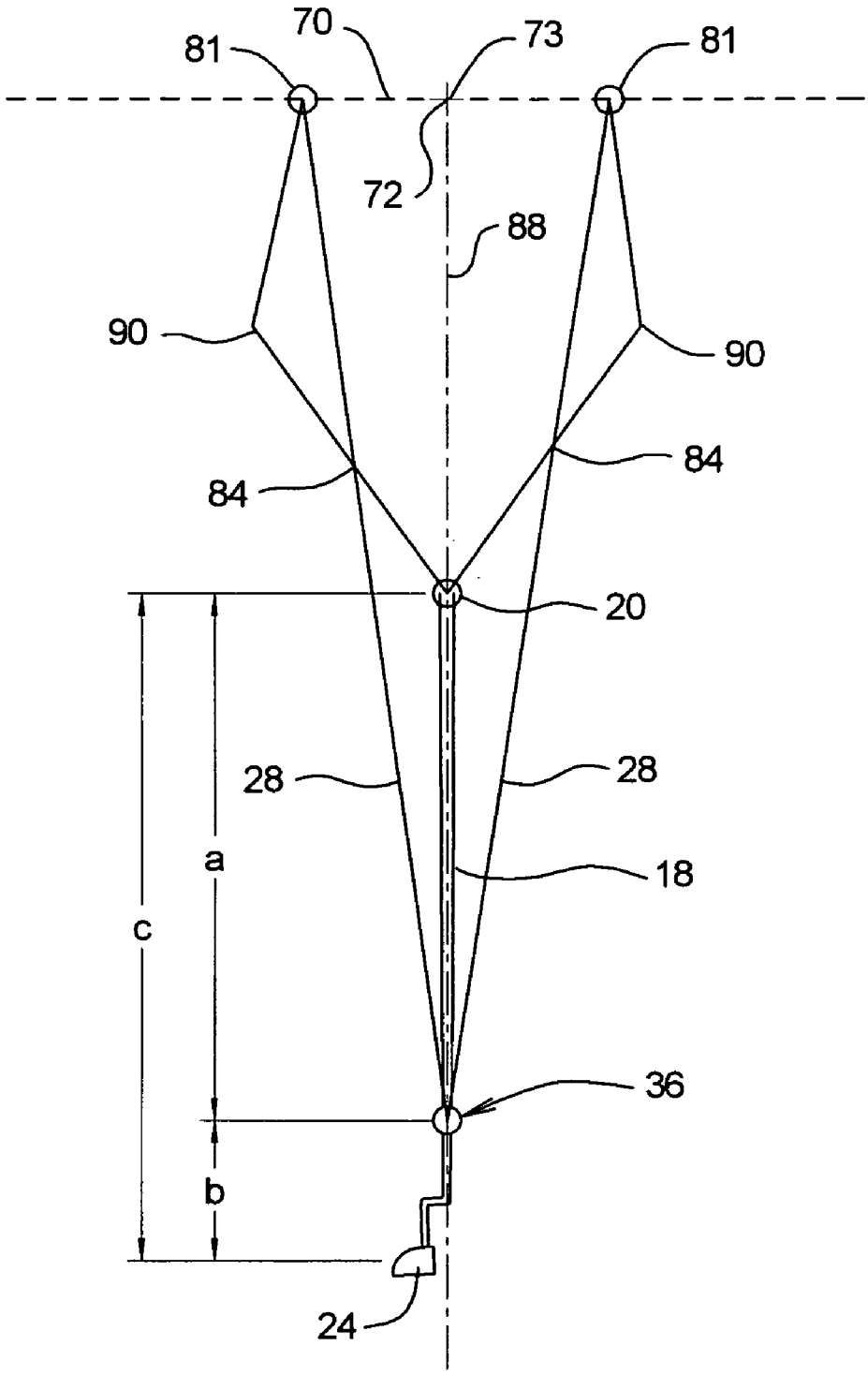
FIG. 4B is a schematic drawing showing in a schematic form the components and relationships that are shown in FIG. 4A and discussed in the text relative to FIGS. 4A and 4B.
Figure 5:
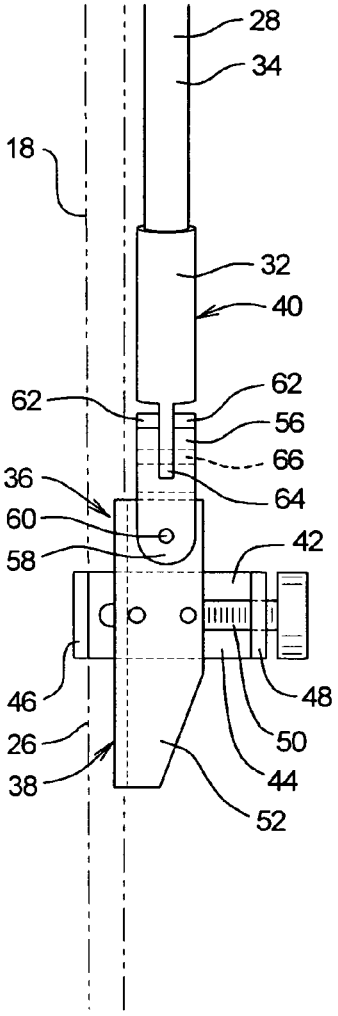
FIG. 5 is a side view of the connecting section by which components of the apparatus are joined one to another and making a connection with the lower end of the shaft.

To illustrate these relationships in a simpler form, reference is made to FIG. 4B. For purposes of illustration, the width dimension of the location 81 has been expanded somewhat relative to the vertical dimension. The orientation of the shaft 18 of the putter 12 is determined by the two locations 20 and 36. The lower location 36 is dictated by the positioning of the two positioning members 28, which in turn are determined by the two fixed points 81. Thus, if the two points 81 remain stationary, then there is no movement of the lower shaft location 36, and if the two points 81 move, the lower shaft location 36 moves.

Likewise, the location 20 is determined by the two substantially fixed locations 90 which correspond to the location of the golfer's elbows which are substantially locked in place by the upper arm portions 78 pressing against the upper torso side portions and against the upper body contact portions of 30 of the positioning members 28. Therefore, when the golfer rotates his/her upper torso about the forward to rear axis of rotation 72, the entire substantially stationary structure comprising the points 81—81, 90—90, 20 and 36 rotate in a clockwise direction (for a right handed golfer)on the backstroke and then a counter-clockwise direction on the forward stroke of the putter head 24. Thus, as the golfer moves from the position of FIG. 1 to that of FIG. 2, the movement of the putter moves in a predictable manner controlled substantially entirely by the movement of the upper torso 80 of the golfer 16. The same is true of the forward stroke from the position of FIG. 2 to the position of FIG. 3.

Also, it is evident from viewing FIGS. 1–3 and also FIG. 4 that the upper intermediate portions of the positioning members rest on the golfer's forearms 82. With the upper body contact portions 30 of the positioning members 28 being fixed to the upper side torso portions, the support provided by the forearms 82 engaging the positioning member 28 fixes the forward to rear location of the putter head 24 relative to the arms and torso of the golfer.

With regard to the relative dimensions and positioning of these significant locations as described above, with further reference to FIG. 4B, the distance from the top of the hand grip location at 20 to the connecting location at 36 (indicated at "a" in FIG. 4B) is in this embodiment about three times the distance from the connecting location 36 to the center of the putter head 24. Thus, if one considers the total distance (indicated at "c") from the hand location 20 to the putter head location 24 as 100%, then the distance "a" would be at about 75% or one quarter of the total length of the putter. Thus, if for some reason there would be a lateral movement at the hand location 20 of, for example, one inch with the positioning described above, the corresponding lateral movement of the putter head 24 would be about one-third of that distance (i.e., one-third of an inch).

Obviously, these relative dimensions could be changed, primarily by moving the location of the connecting location 36 further downwardly or upwardly along the putter shaft 18. For example, the connecting location 36 could be moved downwardly toward the putter head 24 so that this percentage would be 80%, 85%, 90%, or 95%. Likewise, it could be moved upwardly to a location of the connecting section 36 being at 70%, 65%, 60%, 55%, 50%, 45%, 40%, 35%, 30% or possibly smaller. This could be done, for example, to practice the putting stroke while focusing on certain components of the stroke. For example, if the connecting point 36 is moved upwardly closer to the location of the hand location 20, then this would cause greater restraint of the hand location relative to the lateral positioning of the putter head 24. Present analysis of the putting stroke would indicate that the distance from the connecting location 36 to the putter head 24 would be no greater than about one third or one-half of the total distance from the putter head 24 to the top of the hand grip location 20 for the normal operating mode when practicing the putting stroke. Further, by placing the connecting location 36 closer to the location of the putter head 24, movement of the putter head 24 relative to the person's upper torso would be more limited.

With the positioning members 28 in the position shown in FIGS. 1 through 4, the upper body contact portion 30 of the positioning member 28 extends at a downward and forward slant which is no greater than about one half of a right angle from vertical alignment and in a narrower range no greater than a third of a right angle, or a fourth or a fifth of a right angle, with this angle being illustrated at "a" in FIG.4.

Figure 9:
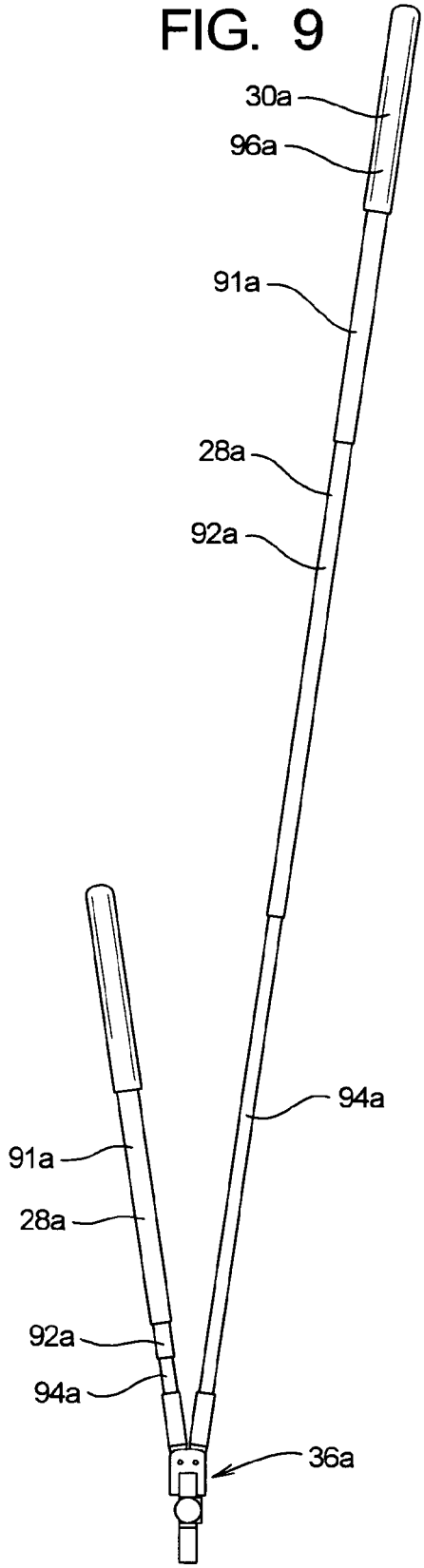
FIG. 9 is a view of a second embodiment of the apparatus, where positioning members are made as telescoping members.
Figure 10:
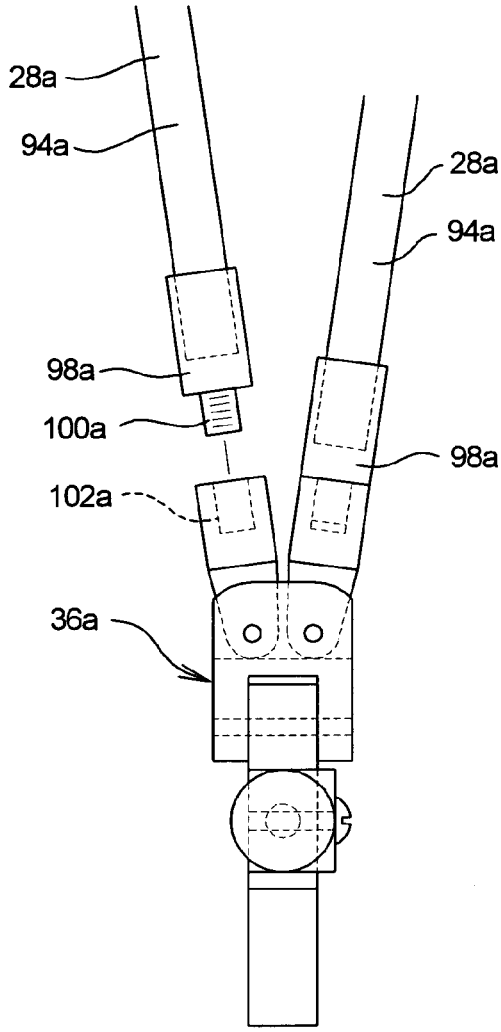
FIG. 10 is a view of the second embodiment where the positioning members are shown as being removably attached to the connecting section.

The second embodiment of the present invention is shown in FIGS. 9 and 10. Components of this second embodiment are similar to components of the first embodiment will be given like numerical designations with an "a" suffix distinguishing those in the second embodiment.

In FIG. 9, there are the two positioning members 28*a* and also the connecting section 36*a*. The positioning members 28*a* are made with three telescoping sections 91*a*, 92*a*, and 94*a*. Further, at the upper end of the upper telescoping section 91*a* there is an upper end covering member 96*a* which is made of a high friction material which is reasonably resilient so as to make the gripping of the upper contact portion more comfortable, and also to better secure the upper end contact portion 30*a* more effectively. In FIG. 10, the lower positioning member section 94*a* is shown having an end fitting 98*a* with a threaded male member 100*a*, which fits in a matching socket 102*a* so that the positioning member 28*a* can be removed from the connecting member 36*a* and placed in the collapsed position for storage.

Figure 11:
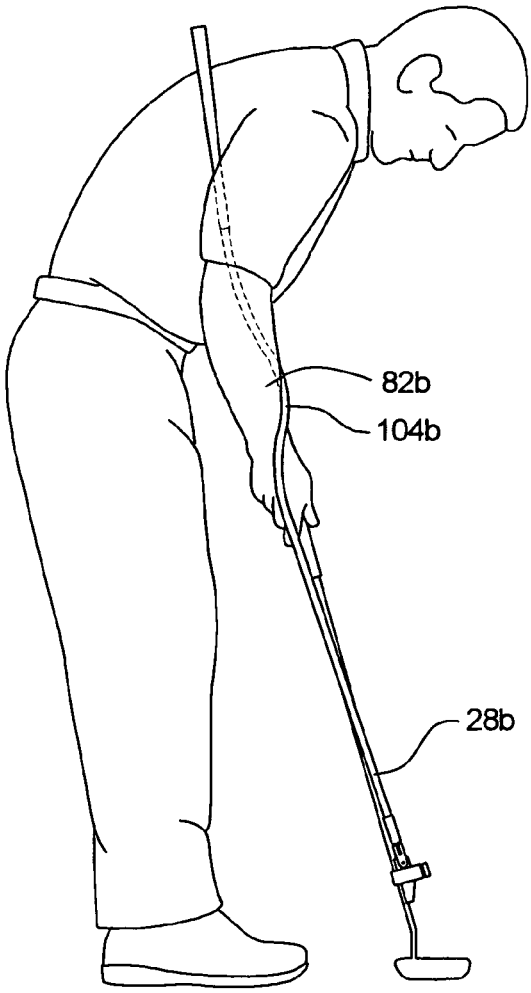
FIG. 11 is a side elevational view similar to FIG. 4, showing a third embodiment of the present invention.

FIG. 11 shows a third embodiment of the present invention. Components of this third embodiment which are similar to those of the first embodiment will be given like numerical designations with a "b" suffix distinguishing those of the third embodiment.

The positioning members 28*b* are contoured generally the same as in the first embodiment, except that at the location where the positioning members 28 crosses over the forearm 82 of the person, these are made with a raised curved portion as indicated at 104*b*, so as to fit the contour of the person's forearm 82.

Figure 12:
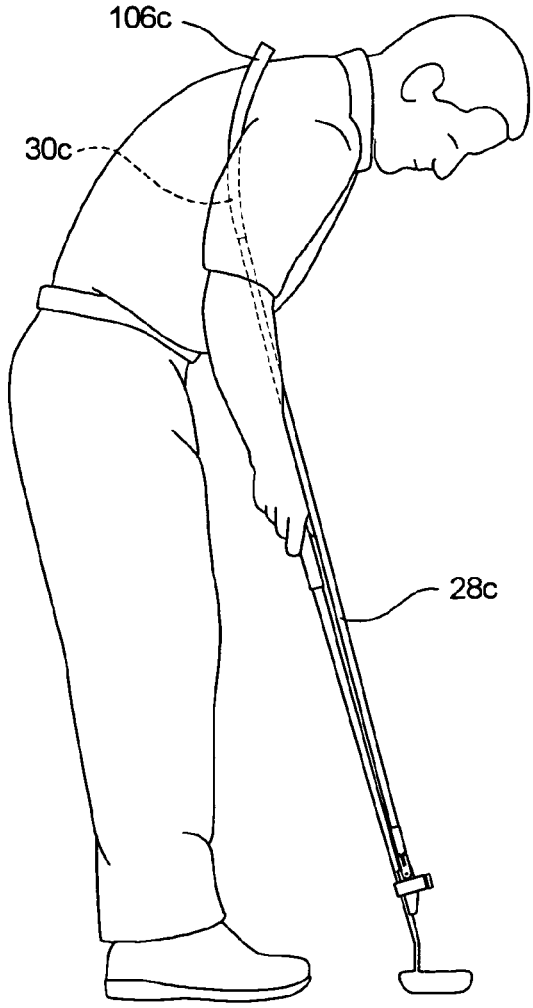
FIG. 12 is a view similar to FIG. 11, showing a fourth embodiment of the present invention.

FIG. 12 shows a fourth embodiment of the present invention. Components of this fourth embodiment which are similar to or the same as the first embodiment will be given like numerical designation with a "c" suffix distinguishes those of the third embodiment.

In this third embodiment, the positioning members 28*c* are essentially the same as in the first embodiment, except that at the upper end contact portions 30*c* of the positioning members 28*c*, the positioning members 28*c* have an end portion 106*c* at an angle slanted with respect to the lengthwise axis of the positioning member 28*c*, this being shown at 106*c*. In this particular embodiment, this slanted end portion 106*c* is extending in a curved upward and forward direction so that the curved portion is adjacent to (or in contact with) the portion of the person's anatomy between the upper back portion of the arm and the upper rear side torso portion. Obviously, the particular configuration of this end portion 106*c* could be modified.

Figure 13:
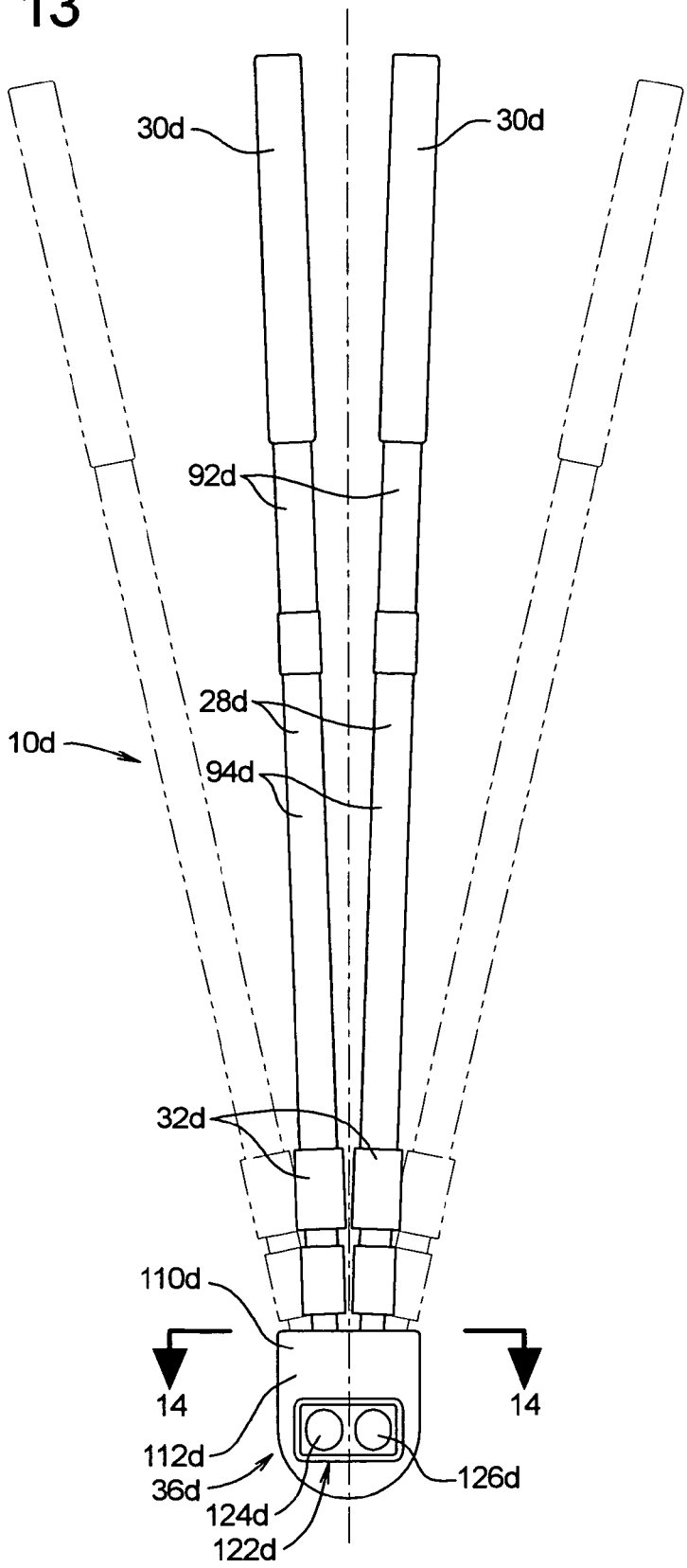
FIG. 13 is a view of a fifth embodiment of the present invention taken from a view in front of the apparatus.
Figure 14:
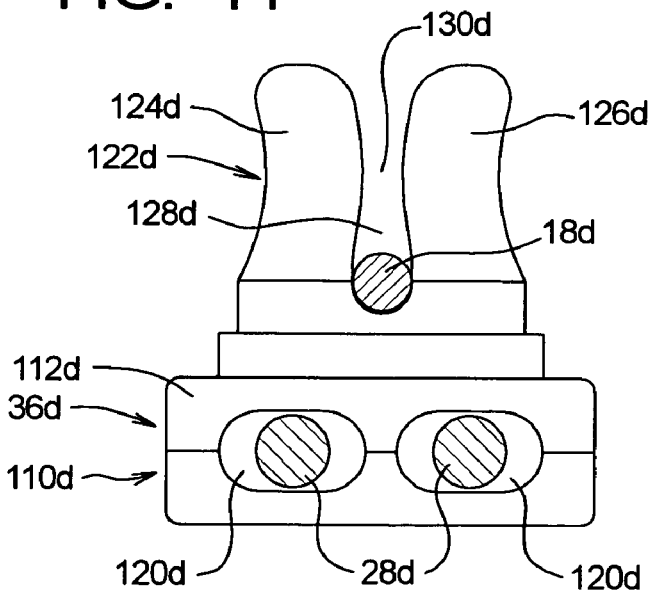
FIG. 14 is a sectional view along line 14—14 of FIG. 12.
Figure 15:
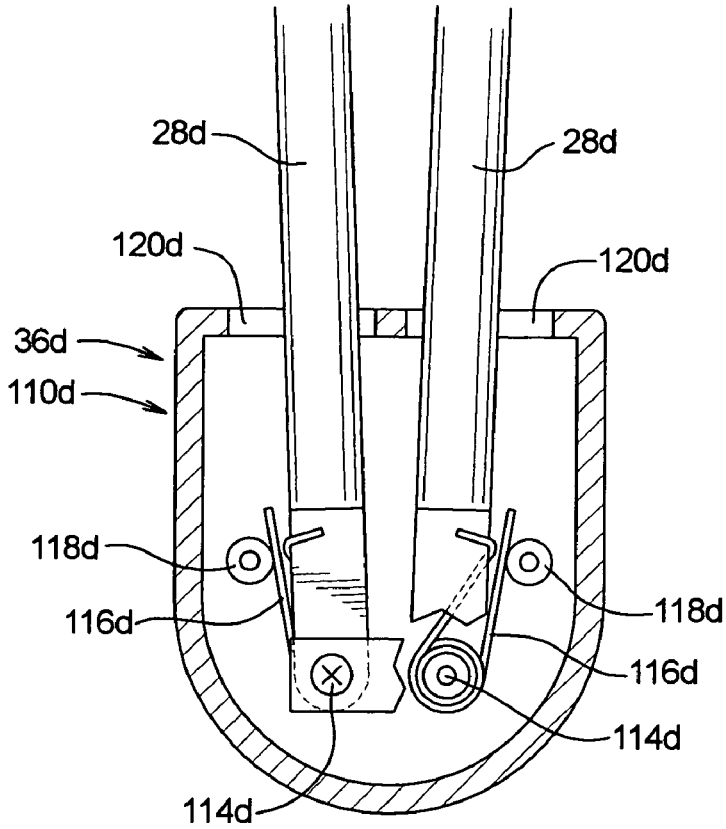
FIG. 15 is a view taken from the same location as FIG. 13, but having the front cover portion of the connecting section removed.

A fifth embodiment of the present invention will now be described with reference to FIGS. 13, 14 and 15. Components of this fifth embodiment which are similar to components of the earlier embodiments will be given like numerical designations, with a "d" suffix distinguishing those of the fifth embodiment. The apparatus 10*d* comprises the two positioning members 28*d* having the upper torso contact portions 30*d* and lower putter connecting portions 32*d* by which the positioning members 28*d* are pivotally connected to the connecting section 36*d*. In this embodiment, the two positioning members 28*d* are each made as a pair of telescoping members 92*d* and 94*d*.

The contact portion 36*d* has a two part housing 110*d* having forward and rear housing sections connecting to each other, for example, by screws. The front housing portion 112*d* is shown in FIG. 13. In FIG. 15, the housing 110*d* has the front housing portion 112*d* removed, this being done to illustrate the connecting portion 36*d*. There are two pivot connections 114*d*, in the form of pins mounted to the rear housing portion. The two lower end connecting portions of the positioning members 28*d* pivotally connect to these pins 114*d*. In addition a pair of springs 116*d* are connected to these pins 114*d* and these engage the lower end portions of the two positioning members 28*d* to urge them toward one another in a closed position. These two springs 116*d* act against a pair of stubs 118*d*. The housing 110*d* is formed with upwardly facing slots through which the slots 120*d* through which the positioning members 28*d* extend.

There is a putter connecting device 122*d* which is fixedly mounted to the front housing portion 112*d*. This device 122*d* comprises two fingers 124*d* and 126*d* which are fixedly mounted to, and extend forwardly from the front housing portion 112*d*. These two fingers 124*d* and 126*d* define a slot 128*d* that is slightly narrower than the diameter of the putter shaft 16*d*. Also, the slot 128*d* is formed with a moderately narrowed entry portion 130*d*. These two fingers 124*d* and 126*d* are made of a relatively stiff rubber-like material that is able to grip the putter shaft and retain it in the slot 128*d*. Yet these fingers 124*d* and 126*d* are sufficiently yielding so that the putter shaft would be able to rotate slightly. Thus, the golfer in grasping the grip portion of the putter would still have the feel of having control of the putter at the hand grip portion so he would have a certain amount of back and forth movement of the putter while it is still held by the fingers 124*d* and 126*d*.

The mode of operation of this fifth embodiment is substantially the same as the earlier embodiments, in that the putter is connected to the connecting portion 36*b* by being placed in the slot, defined by the fingers 124*d* and 126*d*. The upper torso connecting portions 30*d* of the positioning members 28*d* are positioned between the golfer's upper arm portions and the golfer's torso in the manner described above. Then the putting stroke is executed in the same manner as described previously in this text.

Various modifications can be made to the present invention without departing from the basic teachings thereof.

I claim:

1. A method of assisting a golfer to improve the golfer's ability to utilize a putter in a putting stroke, with the putter comprising a shaft having a shaft upper end portion at which there is a hand grip portion and a putter head at a lower shaft end portion, and the golfer having a torso comprising an upper torso portion with two upper torso side portions, two arms with each arm comprising an upper arm portion, a forearm portion, and a hand, said method comprising:

a) providing an apparatus comprising two elongate positioning members, each comprising an upper positioning member torso engaging portion, a lower positioning member connecting portion and a positioning member intermediate portion;

b) connecting the positioning member connecting portions of the positioning members to the putter at a connecting location or locations below the hand grip portion;

c) positioning the upper positioning member torso engaging portions of the positioning members at the upper torso side portions of the golfer, with the golfer then pressing the golfer's upper arm portions toward the upper torso side portions in a torso engaging position to hold the upper positioning member torso engaging portions in place at the upper torso side portions of the golfer;

d) the golfer gripping the hand grip portion of the putter in the golfer's hands, with the golfer's upper arm portions in the torso engaging position, with the result that the golfer's upper torso portion, arms and hands are at substantially stationary locations relative to one another and the putter is at a substantially stationary position relative to the golfer's upper torso;

e) the golfer executing a putting stroke by moving the golfer's upper torso relative to a lower portion of the golfer's body.

2. The method as recited in claim 1, further comprising providing a connecting section which is connected to the putter shaft and to the lower positioning member connecting portions of the positioning members.

3. The method as recited in claim 2, wherein the connecting section is vertically adjustable in its position on the shaft.

4. The method as recited in claim 3, further comprising providing the lower positioning member connecting portions of the positioning members to be moveable angularly relative to the connecting section.

5. The method as recited in claim 1, further comprising providing the lower positioning member connecting portions of the positioning members to be moveable angularly relative to the connecting section.

6. The method as recited in claim 2, wherein both lower positioning member connecting portions are connected at substantially the same location along the length of the shaft.

7. The method as recited in claim 6, wherein the lower positioning member connecting portions are pivotally connected on the shaft.

8. The method as recited in claim 7, wherein said pivot connections are provided as universal pivot connections.

9. The method as recited in claim 8, wherein said putter is removably connected to the connecting section.

10. The method as recited in claim 9, wherein said connecting section is provided as a resilient gripping member defining a retaining slot to receive said shaft so that said shaft is removably connected to the connecting member.

11. The method as recited in claim 1, wherein the golfer positions his/her arms are positioned relative to the positioning members so that the golfer's forearms are in engagement with the positioning members.

12. The method as recited in claim 11, wherein said positioning members are provided in a contoured configuration so as to define a contoured portion thereof arranged to engage the forearms of the golfer.

13. The method as recited in claim 1, wherein the upper positioning member torso engaging portions are when engaged by the upper arm portions aligned so as to have a downward and forward slant relative to a vertical line no greater than about half a right angle.

14. The method as recited in claim 1, wherein the lower positioning member connecting portions connect to the shaft of the putter at a location that is no higher than about two thirds of the length dimension of the putter from the putter head.

15. The method as recited in claim 14, wherein the lower positioning member connecting portions connect to the shaft of the putter at a location that is no higher than about on half of the length dimension of the putter from the putter head.

16. The method as recited in claim 1, wherein the lower positioning member connecting portions are connected to the shaft at a location no higher than about one third of the length of the shaft of the putter from the putter head.

17. The method as recited in claim 1, wherein each of said positioning members is provided as a plurality of telescoping members which can be extended or contracted relative to one another.

18. The method as recited in claim 1, wherein at least one of said positioning members has an upper end portion extending beyond upper positioning member torso engaging portions and in a direction behind a back portion of the golfer's torso.

19. A method of assisting a golfer to improve the golfer's ability to utilize a putter in a putting stroke, with the putter comprising a shaft having a shaft upper end portion at which there is a hand grip portion and a putter head at a lower shaft end portion, and the golfer having a torso comprising an upper torso portion with two upper torso side portions, two arms with each arm comprising an upper arm portion and a forearm portion, and a hand, said method comprising:

a) providing an apparatus comprising two elongate positioning members, each comprising an upper positioning member torso engaging portion, a lower positioning member connecting portion and a positioning member intermediate portion;

b) connecting the positioning member connecting portions of the positioning members to the putter at a connecting location or locations below the hand grip portion;

c) positioning the upper positioning member torso engaging portions of the positioning members at the upper torso side portions of the golfer, with the golfer then pressing the golfer's upper arm portions toward the upper torso side portions in a torso engaging position to hold the upper positioning member torso engaging portions in place at the upper torso side portions of the golfer;

d) the golfer gripping the hand grip portion of the putter in the golfer's hands, with the golfer's upper arm portions remaining in the torso engaging position, with the result that the golfer's upper torso portion, arms and hands are at substantially stationary locations relative to one another and the putter is at a substantially stationary position relative to the golfer's upper torso, and with the positioning member intermediate portions being in contact with forearm portions of the golfer;

e) the golfer executing a putting stroke by moving the golfer's upper torso relative to a lower portion of the golfer's body portion.

20. An apparatus for assisting a golfer to improve the golfer's ability to utilize a putter in a putting stroke in a manner that the apparatus is used by the golfer in a use position while the golfer is gripping the putter in a putting stance while executing the putting stroke, with the putter comprising a shaft having a shaft upper end portion at which there is a hand grip portion and a putter head at a lower shaft end portion, and the golfer having a torso comprising an upper torso portion with two torso side portions, two arms with each arm comprising an upper arm portion and a forearm portion, and a hand, said apparatus comprising:

a) two elongate positioning members, each comprising an upper positioning member torso engaging portion, a lower positioning member connecting portion and a positioning member intermediate portion;

b) a connecting section to which the connecting portions are pivotally connected and which has a putter connecting portion arranged to be removably connected to the putter at a location below the hand grip portion of the putter;

c) said positioning members being arranged so that in the use position said upper positioning member torso engaging portions of the positioning members are able to be positioned at the upper torso side portions of the golfer, in a manner that the golfer is able to press the golfer's upper arm portions toward the upper torso side portions to press the upper positioning member torso engaging portions in place at the upper torso side portions of the golfer, with the positioning members having sufficient length so that with the golfer in the putting stance and gripping the hand grip portion of the putter in the use position in the golfer's hands, and with the golfer's upper arm portions remaining substantially stationary relative to the upper torso of the golfer, the connecting section is connected to the putter at a location below the hand grip portion of the putter, whereby the golfer is able to execute a putting stroke by moving the golfer's upper torso relative to a lower portion of the golfer's body, with the golfer's upper torso portion, arms and hands being at substantially stationary positions relative to one another and the putter being at a substantially stationary position relative to the golfer's upper torso.

21. The apparatus as recited in claim 20, wherein the connecting section has a connecting position which is vertically adjustable on the shaft.

22. The apparatus as recited in claim 20, wherein the connecting of the apparatus connected to the putter so that there is an apparatus/putter assembly arranged to be used by the golfer in executing the putting stroke.

* * * * *